United States Patent [19]

Everman

[11] Patent Number: 4,578,051

[45] Date of Patent: Mar. 25, 1986

[54] FILM TUBE GUSSET FORMING MACHINE

[75] Inventor: Wayne F. Everman, Cedar Falls, Iowa

[73] Assignee: Container Corporation of America, Chicago, Ill.

[21] Appl. No.: 705,325

[22] Filed: Feb. 25, 1985

[51] Int. Cl.[4] ..... B31B 1/12; B31B 1/36

[52] U.S. Cl. ..... 493/8; 493/439; 493/450; 251/4; 251/129.04; 264/40.3; 425/326.1; 137/224

[58] Field of Search ..... 493/8, 9, 34, 439, 450; 251/61.1, 4, 129.04; 137/224.5, 224, 223; 340/626, 539; 441/92, 96; 425/326.1; 264/40.3

[56] References Cited

U.S. PATENT DOCUMENTS

| | | | |
|---|---|---|---|
| 2,118,165 | 5/1938 | Christopher et al. | 441/92 |
| 2,631,332 | 3/1953 | Reber | 493/450 |
| 2,961,930 | 11/1960 | Wamsley et al. | 493/439 |
| 3,566,756 | 3/1971 | Schmid | 493/439 |
| 3,990,464 | 11/1976 | Jenkins | 137/1 |
| 4,109,895 | 8/1978 | Smart et al. | 257/41 |
| 4,207,887 | 6/1980 | Hiltebrandt et al. | 128/207.28 |
| 4,316,176 | 2/1982 | Gee et al. | 340/58 |
| 4,462,779 | 7/1984 | Brinkmeier et al. | 425/140 |

*Primary Examiner*—Francis S. Husar
*Assistant Examiner*—William E. Terrell
*Attorney, Agent, or Firm*—Richard W. Carpenter

[57] ABSTRACT

A machine for converting tubular plastic film from flat fold to pleated fold cross section which includes self-contained radio controlled inflating capsule positioned within the tube to inflate it as the gussets are being formed by conventional forming or plowing mechanism.

10 Claims, 6 Drawing Figures

FILM TUBE GUSSET FORMING MACHINE

BACKGROUND OF THE INVENTION

This invention relates generally to equipment for forming gussets in tubular plastic film, and more particularly to a film gusseting machine that utilizes a radio operated capsule disposed within the blown portion of the film for inflating the film as it is being advanced while the gussets are being formed.

SUMMARY OF THE INVENTION

The object of the invention to provide, in a film tube gusseting machine, a device for maintaining within the portion of the film being gusseted an inflation pressure sufficient to permit the gusset forming means to function properly.

A more specific object of the invention is the provision, in a gusset forming machine, of a means for maintaining the blown film at the proper inflation without having to puncture or damage the film in any way.

A more specific object of the invention is the provision, in a device in the type described, of a self contained inflating capsule mechanism that can be positioned within the blown portion of the film and which can be controlled by a radio transmitter located outside of the film.

Another specific object of the invention is the provision, in a device in the type described, of a radio controlled capsule for inflating the film which is positioned within the film and which is controlled automatically by means of a sensing device engagable with the outside surface of the film.

These and other objects of the invention will be apparent from the examination of the following description and drawings.

It will be understood that, for purposes of clarity, certain elements may have been intentionally omitted from certain views where they are believed to be illustrated to better advantage in other views.

DESCRIPTION OF THE PRIOR ART

The usual means for forming pleats or gussets in tubular film stock is to inflate a portion of the film as it passes between separate sets of nip rolls and then fold or plow in the sides of the film by mechanical plows or forming devices.

One of the problems encountered in this type of operation is that of maintaining adequate pressure within the portion of the film being gusseted so that the gusset forming devices can function properly and unformly.

In the past it has been necessary intermittently to puncture that portion of the film being gusseted and then insert sufficient air by means of a needle or similar mechanism. This, of course, damages certain portions of the film requiring those portions to be discarded.

DESCRIPTION OF THE PREFERRED EMBODIMENT

The present invention provides a means for insuring a uniform inflation pressure at all times within the blown portion of the film which is being gusseted without damaging the film in any way.

Figure 3:
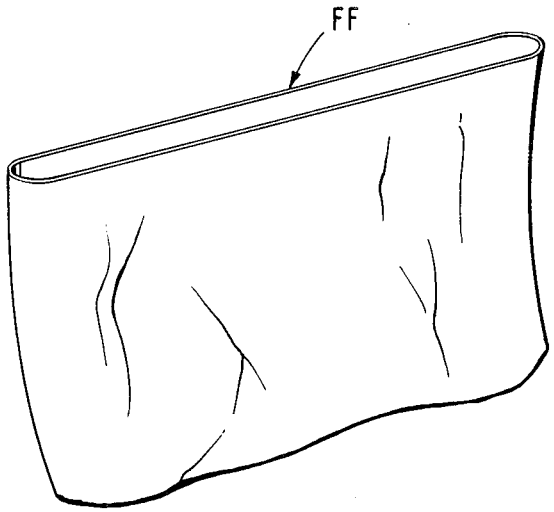
FIGS. 3 and 4 are fragmentary perspective views illustrating the tubular plastic film as seen before and after the gussets have been formed by the machine, respectively.
Figure 4:
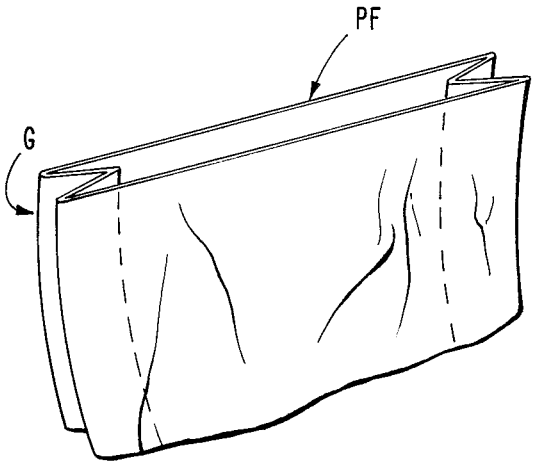

Referring now to the drawings for a better understanding of the invention, and first to FIGS. 3 and 4, it will be seen that the pleated fold film with gussets G, indicated at PF in FIG. 4, can be formed from conventional flat fold film stock indicated at FF in FIG. 3.

Figure 1:
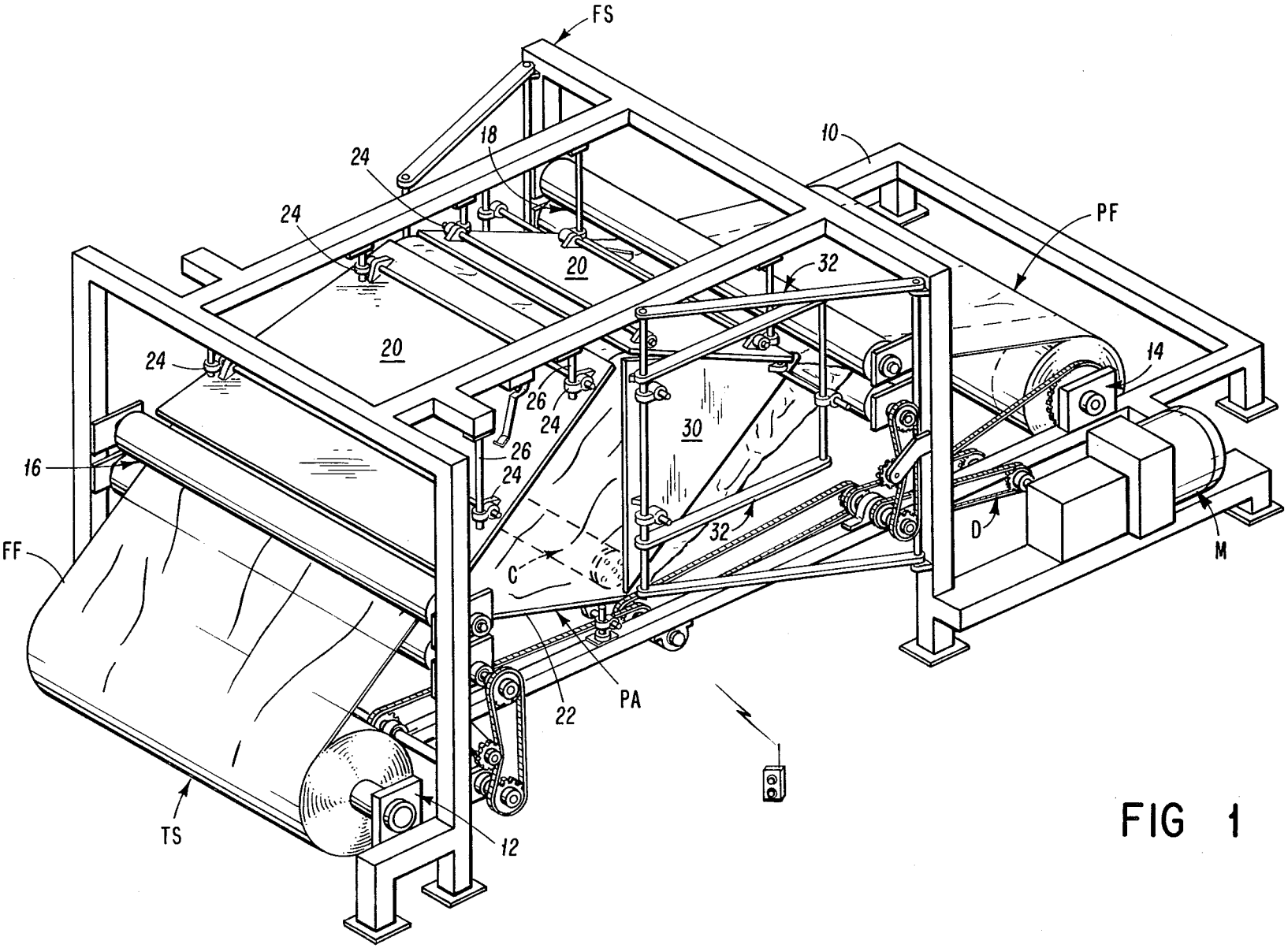
FIG. 1 is a perspective view of the film gusseting machine embodying feature of the invention.

Now referring to FIG. 1 of the drawings it will be seen that the novel machine embodying features of the invention comprises a frame assembly, indicated generally at FS, which includes a frame indicated generally at 10.

FIG. 10 includes a pair of front and rear supports, 12 and 14, for holding unfinished tubular film stock roll TS and a finished film stock roll PF, respectively.

Mounted on the frame between the film supporting means is a gusseting or pleating assembly indicated generally at PA which includes first and second set of nip rolls or film feed rolls 16 and 18, respectively, which are positioned inwardly adjacent the front and rear film supports 12 and 14.

The portion of the film located between the first and second sets of nip rolls is inflated in a manner described later in the specification. As the tubular film is inflated it is necessary to restrain the film and maintain it in a predetermined shape, which in the present case is preferably diamond shaped, as seen from the side and generally rectangular as, seen from the top, and illustrated in the schematic view of FIG. 2.

The maintaining of the blown film in a predetermined shape is accomplished by upper and lower sets of restraining boards 20 and 22, respectively, which are pivotally connected by means of pivotal connections 24 and arms 26 to upper and lower portions of the frame. These restraining boards serve as a mold to maintain the film in a specific predetermined contour as it is being advanced between the first and second set of nip rolls.

In order to monitor and control the degree of inflation within the film there is provided a sensing device, indicated generally at R, which is linked to one of the upper restraining boards 20 by means of a linkage indicated generally 28.

The actual forming of the pleats or gussets in opposite sides of the tubular film is accomplished by a pair preferably triangular gusset forming boards or plows 30 which are pivotally connected to frame F by means of a sub-assembly indicated generally at 32, and illustrated in FIG. 1.

As previously mentioned, the unique feature of the present invention, which distinguishes it from all known prior art, is the mechanism for inflating that portion of the tubular plastic film being advanced between the nip rolls and maintaining it at a proper inflation level so the gusset forming boards or plows 32 will be able to form the film into the desired gusseted or pleated form.

Figure 2:
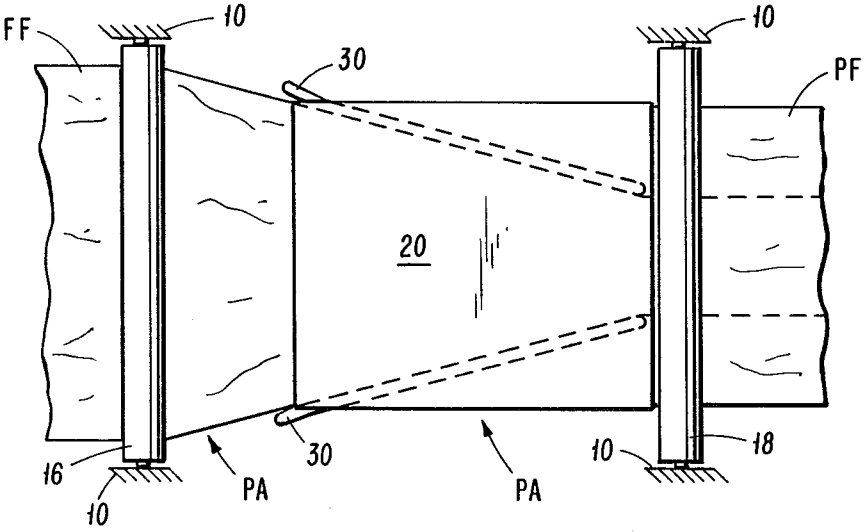
FIGS. 2 and 2A are schematic diagrams illustrating portions of the gusset forming mechanism shown in FIG. 1.
Figure 2A:
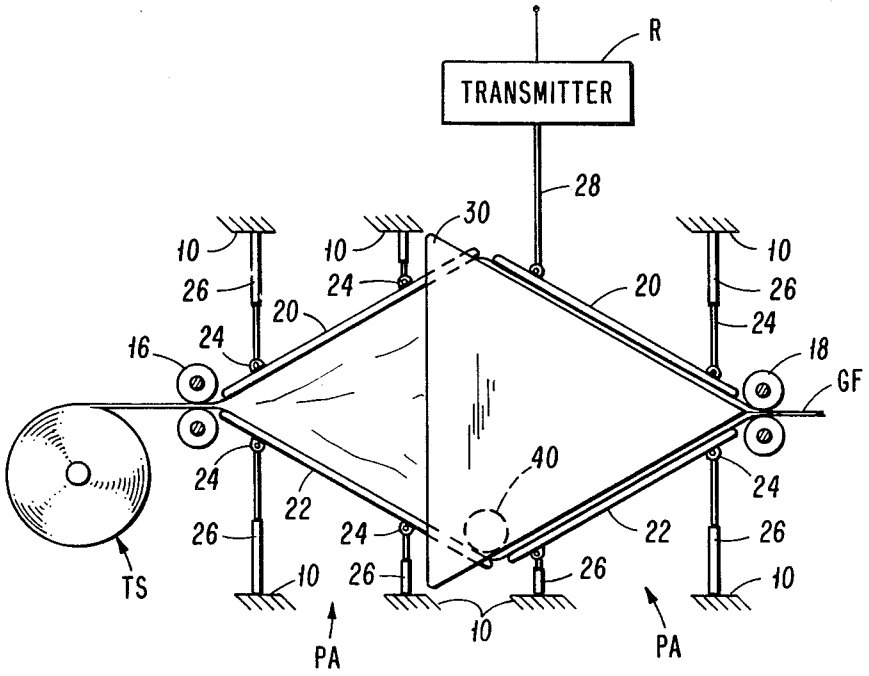

In the present invention the inflation of the tubular film is accomplished by means of a self contained cannister or capsule, indicated generally at 40, which is positioned within the film tube itsefl and is generally cylindrical in shape, so that as the film moves forward the capsule can stay in position at the bottom of the film portion between the forming boards, as shown in FIG. 2.

The capsule 40 has a generally cylindrical side wall or body 50 with a pair of removable end walls 54 which are held together by axially extended tie rods 54.

Figure 5:
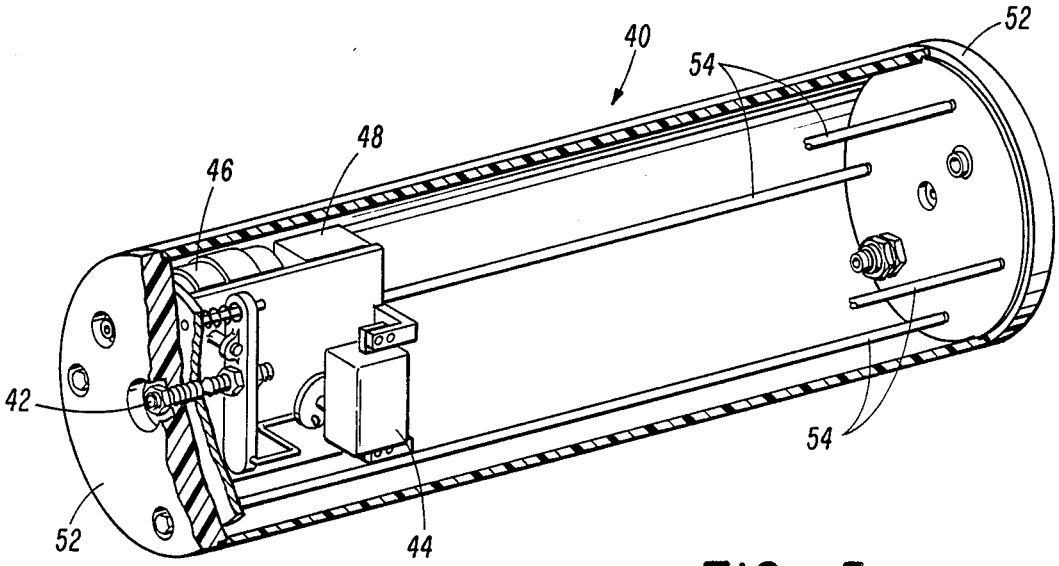
FIG. 5 is a perspective view, partially in section illustrating the inflating device shown in the other views.

Positioned within the capsule 40, as best seen in FIG. 5, is a valve 42, mounted in one of the end walls 52; a motor 44; a battery 46 for powering the motor; and a receiver 48 for operating the motor and valve.

As previously mentioned, the sensing device, indicated generally at R, and illustrated in FIG. 2, includes a radio transmitter which, after being activated by the linkage 28, determines that more air is needed to maintain adequate inflation pressure between the blown portion of the film, transmits the appropriate message to the receiver 48 within the capsule 40 causing the motor to open the valve and admit the appropriate amount of air from within the capsule to within the blown portion of the film.

Thus, the invention provides a unique means for maintaining adequate pressure on film to permit the gusseting operation, and, at the same time, does not cause any damage to the film as the gussets are being formed.

What is claimed is:

1. A machine for converting tubular plastic film from flat fold to pleated fold cross section, comprising:

(a) a frame;

(b) first and second film holding means mounted on said frame and spaced from each other for holding tubular plastic film in flat fold condition and pleated fold condition, respectively;

(c) a film pleat forming assembly mounted on said frame intermediate said first and second film holding means;

(d) said pleat forming assembly including:

(i) first and second sets of nip rolls spaced from each other adjacent said first and second film holding means, respectively;

(ii) means for advancing said film between said sets of nip rolls;

(iii) means for inflating that portion of the film passing between said sets of nip rolls;

(iv) means for maintaining said inflated film in a specific shape;

(v) means for forming pleats or gussets in opposite sides of said film before said film enters said second set of nip rolls;

(e) said inflating means including an air filled container positioned within said tube of film between said sets of nip rolls and having a valve including a radio receiver for operating same;

(f) a radio transmitter located without said tube for transmitting signals to said valve operating receiver.

2. A method for converting tubular plastic film from flat fold to pleated fold cross section, comprising:

(a) providing a length of plastic film in the form of a tube;

(b) inserting into said length of said tubular film a container of air having a radio controlled valve for releasing from said container a sufficient amount of air to inflate said length of tubular film to the desired degree;

(c) providing outside of said length of tubular film a radio of controlling said valve;

(d) confining opposite ends of a length of said film between first and second said sets of nip rolls;

(e) inflating said length of film between said sets of nip rolls through said radio controlled container valve;

(f) advancing said length of film between said sets of nip rolls;

(g) while said length of film is being advanced:

(i) maintaining a predetermined contour therefor by engaging upper and lower surfaces thereof with forming elements;

(ii) forming gussets therein by engaging the sides thereof with gusset forming elements.

3. A machine for converting tubular plastic film from flat fold to pleated fold cross section, comprising:

(a) a frame;

(b) means providing a tubular web of plastic film;

(c) a film pleat forming assembly mounted on said frame and downstream from said film providing means including:

(i) first and second sets of nip rolls spaced from each other;

(ii) means for advancing said film between said sets of nip rolls;

(iii) inflating means, located within the film portion being advanced between said sets of nip rolls including a capsule with a valve which can be radio controlled from without said film portion, for inflating said film portion;

(iv) valve controlling radio means located without said film portion;

(v) contouring means for forming pleats or gussets in opposite sides of said film before said film enters said second set of nip rolls.

4. A machine according to claim 3, wherein said inflating means includes an air filled capsule positioned within said tube of film between said sets of nip rolls and having a remote radio controlled valve, and a radio transmitter located without said tube of film.

5. A machine according to claim 4, wherein said capsule includes:

(a) a valve for dispensing air into said tube of film;

(b) a motor for operating said valve;

(c) a radio receiver for controlling said motor.

6. A machine according to claim 4, and including a control device in direct engagement with an outside surface of said tube of film to sense the degree of inflation in said tube and to automatically transmit appropriate signals to said capsule to control the valve thereof.

7. A machine according to claim 5, and including a sensing device in direct engagement with an outer surface of said tube of film and a transmitter responsive to said sensing device for sending valve control signals to the receiver in said capsule.

8. A machine according to claim 3, and including first and second film holding means, mounted on said frame outwardly of said first and second sets of nip rolls, for holding tubular plastic film in flat fold condition and pleated fold condition, respectively.

9. A machine according to claim 3, wherein said means for maintaining said inflated film in a specific shape includes sets of flat plate elements partially mounted on said frame and engageable with outer surfaces of said film.

10. A machine according to claim 3, wherein said pleat forming means includes a pair of forming elements movably mounted on opposite sides of the frame for engagement with opposite sides of said tube of flim.

* * * * *